US007255202B2

(12) United States Patent
O'Keeffe

(10) Patent No.: US 7,255,202 B2
(45) Date of Patent: Aug. 14, 2007

(54) TRUCK MOUNTED FORKLIFT WITH DOUBLE-ACTING FREELIFT MAST

(75) Inventor: Eric O'Keeffe, Monaghan (IE)

(73) Assignee: Moffett Research and Development Limited, Louth (IE)

( * ) Notice: Subject to any disclaimer, the term of this patent is extended or adjusted under 35 U.S.C. 154(b) by 301 days.

(21) Appl. No.: 10/857,346

(22) Filed: Jun. 1, 2004

(65) Prior Publication Data

US 2005/0036864 A1 Feb. 17, 2005

(30) Foreign Application Priority Data

May 30, 2003 (IE) ..... S2003/0413

(51) Int. Cl.
*B66F 9/22* (2006.01)

(52) U.S. Cl. ..... 187/234; 414/467

(58) Field of Classification Search ..... 187/274, 187/273, 226, 229, 230, 233, 234; 414/467, 414/630, 631; 60/476; 91/440
See application file for complete search history.

(56) References Cited

U.S. PATENT DOCUMENTS 2,788,863 A * 4/1957 Ulinski ..... 187/227
3,039,637 A * 6/1962 Akrep ..... 414/632
3,273,665 A * 9/1966 Goodacre ..... 414/631
3,521,780 A * 7/1970 Cook ..... 414/632
4,261,438 A * 4/1981 Olson ..... 187/227
4,280,592 A * 7/1981 Bartow ..... 187/227
4,312,427 A * 1/1982 Stedman ..... 187/227
4,355,703 A * 10/1982 Bartow ..... 187/227
4,363,380 A * 12/1982 Rued et al. ..... 187/274
4,366,883 A * 1/1983 Reeves ..... 187/224
4,374,550 A * 2/1983 Bartow ..... 187/227
4,421,208 A * 12/1983 Robinson, Jr. ..... 187/227
4,485,894 A * 12/1984 Soule et al. ..... 187/229
4,585,093 A * 4/1986 Barda, Jr. ..... 187/227
4,683,988 A * 8/1987 Shrum, Jr. ..... 187/234
4,721,187 A * 1/1988 Riddle ..... 187/227
4,762,203 A * 8/1988 Ryan ..... 187/226
5,065,664 A * 11/1991 Ohta et al. ..... 91/420
5,072,588 A * 12/1991 Lowder et al. ..... 60/571
5,082,090 A * 1/1992 Walker ..... 187/230
5,326,217 A * 7/1994 Simpson et al. ..... 414/635
5,328,321 A * 7/1994 Moffett et al. ..... 414/631

(Continued)

FOREIGN PATENT DOCUMENTS

GB 2260119 A 4/1993

*Primary Examiner*—Patrick Mackey
*Assistant Examiner*—Charles Greenhut
(74) *Attorney, Agent, or Firm*—Jacobson Holman PLLC

(57) ABSTRACT

A forklift truck for mounting on the rear of a carrying vehicle comprises a u-shaped chassis having a crossbar and a pair of side bars mounted at the ends of the crossbar and projecting forwardly therefrom. A wheel is located adjacent the free end of each of the side bars and a steerable rear wheel is located centrally on the crossbar, a drivers station is positioned to one side of the chassis and a motive power unit is positioned on the opposite side of the chassis. The chassis mounts a vertical multi-lift mast having a plurality of mast sections, one of which carries a pair of forks. The fork-carrying mast section further comprises a freelift mast system having means to positively move the forks upwards relative the mast section and means to positively move the forks downwards relative the mast section.

18 Claims, 13 Drawing Sheets

U.S. PATENT DOCUMENTS 5,370,494 A * 12/1994 Holmes et al. ..... 414/635
5,395,201 A * 3/1995 Yamashita et al. ..... 414/467
5,409,346 A * 4/1995 Grether ..... 414/631
5,575,604 A * 11/1996 Dubosh et al. ..... 414/462
5,641,261 A * 6/1997 Talbert et al. ..... 414/544
5,651,657 A * 7/1997 Poindexter ..... 414/541
5,651,658 A * 7/1997 Holmes et al. ..... 414/635
5,788,452 A * 8/1998 Brouwer et al. ..... 414/631
5,813,820 A * 9/1998 Dubosh et al. ..... 414/467
6,062,800 A * 5/2000 Perry et al. ..... 414/467
6,116,843 A * 9/2000 Braud ..... 414/665
6,120,232 A * 9/2000 Dubosh et al. ..... 414/467
6,530,739 B1 * 3/2003 Fridman ..... 414/467
6,572,322 B2 * 6/2003 Karr ..... 414/462
6,675,937 B2 * 1/2004 De Leeuw et al. ..... 187/222
2004/0179925 A1 * 9/2004 O'Keeffe ..... 414/467
2005/0220588 A1 * 10/2005 Turnbull et al. ..... 414/467

* cited by examiner

TRUCK MOUNTED FORKLIFT WITH DOUBLE-ACTING FREELIFT MAST

This invention relates to a forklift truck for mounting on the rear of a carrying vehicle, the forklift truck comprising a U-shaped chassis having a crossbar and a pair of side bars mounted at the ends of the crossbar and projecting forwardly therefrom, a wheel located adjacent the free end of each of the side bars and a steerable rear wheel located centrally on the crossbar, a drivers station positioned to one side of the chassis and a motive power unit positioned on the opposite side of the chassis to the drivers station, the chassis mounting a vertical multi-lift mast, the vertical multi-lift mast having a plurality of mast sections, one of the mast sections carrying a pair of forks, the fork-carrying mast section further comprises a freelift mast system.

BACKGROUND OF THE INVENTION

Truck mounted forklifts, otherwise known as piggyback forklifts, have been known for many years. These forklifts can be mounted on the rear of a carrying vehicle or trailer and transported to customers premises on the back of the carrying vehicle or trailer. Once at the customers premises, the forklift can be dismounted from the carrying vehicle and used to transport goods to and from the vehicle on the customer's premises. These forklifts have been found to be useful particularly when used to transport goods to small businesses that do not have access to a forklift, as the deliveries may be made in a fast and efficient manner whilst at the same time reducing the manual workload required by the operators of the small business.

One such piggy-back forklift is that described in the applicants own UK patent application publication number GB2260119. This application describes a piggyback forklift truck having a multi-lift mast comprising an outer mast section for mounting on the truck, a middle mast section slidably mounted on the outer mast section and an inner mast section slidably mounted on the middle mast section. A carriage carrying a pair of forks is further provided and is in turn slidably mounted on the inner mast section. A first chain mechanism connects the outer mast section to the inner mast section and a second chain mechanism connects the middle mast section to the fork carriage. The first and second chain mechanisms are such that as the middle mast section is raised relative the outer mast section by a pair of hydraulic rams, the inner mast section is caused to rise relative the middle mast section and the fork carriage is caused to rise relative the inner mast section. In this way, a truck mounted forklift having a single pair of rams operable on the outer and the middle mast sections may be used simultaneously to raise both the inner mast section and the forks via the chain mechanisms. Therefore only a single pair of rams is required to operate the mast thereby reducing the overall weight of the forklift. This type of forklift has proved to be very successful in operation.

There is however a problem with the known type of forklift. These forklifts are often required to operate in areas with relatively low overhead clearance. In order to raise the forks of the known type of forklift the mast sections must also be raised at the same time by the rams. This increases the overall height of the forklift which may be unacceptable particularly in areas with restricted overhead clearance. The functionality and usefulness of the forklift is therefore compromised.

One solution to this problem has been the introduction of the so called "freelift" multi-lift masts. These masts are similar to the regular multi-lift masts but differ in the fact that the forks are carried by a freelift system which in turn is mounted on the inner mast section. The freelift system replaces the chains connecting the forks to the middle mast section of the known forklifts and comprises a fluid actuated ram and pulley purchase system connected to the mast section and the forks. The freelift system can raise the forks upwardly by a limited amount relative the inner mast section without increasing the height of the mast simply by operating the fluid actuated ram. In order to lower the forks relative the inner mast section, the fluid actuated ram is released and the forks descend under gravity. In this way, adjustment of the height of the forks is possible even in areas with a low overhead clearance. However, this type of freelift multi-lift mast has been found to be unsuitable for truck mounted forklifts. In order to mount a piggyback forklift onto a truck or trailer, they require what is known as "negative lift" whereby the forks of the forklift engage the truck and the forks are driven downwards to lift the forklift truck clear of the ground up onto the carrying vehicle. Due to the presence of the freelift multi-lift mast, the only force limiting the upwards movement of the forks is the weight of the forks themselves. It is not possible therefore to generate enough negative lift to raise the forklift up onto the vehicle.

One proposed solution to this problem is to provide a locking pin to lock the forks and the inner mast section in a fixed relationship with respect to each other before attempting to mount the forklift onto the vehicle. This has the disadvantage that a considerable amount of time must be spent in aligning the mast section and the forks together before the locking pin may be inserted. Another disadvantage is that the operator of the forklift must alight from the vehicle In order to Insert the locking pin which is inconvenient and further increases the amount of time spent in loading and unloading the forklift from the carrying vehicle. This represents a significant amount of time spent in the mounting of the forklift on the carrying vehicle. Another disadvantage of having to use the locking pins is that these locking pins are prone to loss and damage and should the locking pin be lost or damaged when the forklift is being used offsite, a replacement locking pin has to be provided which can result in the loss of a significant amount of time for the operator of the forklift.

A further situation where negative lift is required is when the piggyback forklift is required to navigate a step that is too large for the wheels of the piggyback forklift to mount alone without assistance. Normally, In order to navigate such a step, the operator of the piggyback forklift will extend the mast carrying carriage to its forwardmost position on the u-shaped chassis so that the forks protrude the maximum distance forward of the forklift. When the mast and forks are in position, the operator of the vehicle drives the vehicle up to the step and lowers the forks down on to the step. The forks are then lowered further until the forklift truck begins to rise relative the step. Once the forklift has risen sufficiently so that the wheels are substantially level with the step, the mast carrying carriage is retracted backwards on the unshaped chassis which has the effect of pulling the entire forklift truck and in particular the front wheels of the forklift truck forwards up onto the step. This can only be achieved by the forklift truck having a mast assembly that is able to provide negative lift. Therefore, when using the known types of piggyback forklift with freelift multi-lift masts the operator of the forklift will have to align the forks with the mast section and insert the locking pin to secure the forks in position so that negative lift may be provided to the forks. The operator of the vehicle may have to navigate a step numerous times during the course of a single delivery. If the operator of the vehicle is forced to align the forks with the inner mast section before dismounting from their vehicle and inserting locking pins each time the step must be navigated, the time required to carry out a delivery will be increased greatly. This is highly undesirable.

Another situation in which negative lift may be required is when the forklift is used to pick up goods that may have been left to rest on soft ground. In certain circumstances these goods may subside into the soft ground thereby making their retrieval more difficult. By having negative lift, the operator of the forklift may use the negative lift to drive the forks of the forklift downwards Into the ground and assist In picking up the pallet or other goods that have subsided. Again, this is only possible with negative lift. If the operator of the vehicle had to move a number of pallets or other goods that had begun to subside then the time taken to effect delivery would be increased significantly as the forks would have to be aligned and the locking pins inserted for each pallet that had to be lifted by the piggyback forklift. It is imperative that the piggyback forklift is able to provide a sufficient degree of negative lift In a quick and efficient manner.

OBJECT OF THE INVENTION

It is an object therefore of the present invention to provide a truck mounted forklift that overcomes at least some of the difficulties associated with the known types of truck mounted forklifts. It is a further object of the present invention to provide a truck mounted forklift with a multi-lift mast having a freelift mast system that is both simple and efficient to use.

SUMMARY OF THE INVENTION

According to the invention there is provided a forklift truck for mounting on the rear of a carrying vehicle, the forklift truck comprising a U-shaped chassis having a cross-bar and a pair of side bars mounted at the ends of the crossbar and projecting forwardly therefrom, a wheel located adjacent the free end of each of the side bars and a steerable rear wheel located centrally on the crossbar. A driver station is positioned to one side of the chassis and a motive power unit is positioned on the opposite side of the chassis to the drivers station. A vertical multi-lift mast is mounted on the chassis, the vertical multi-lift mast having a plurality of mast sections, one of the mast sections carrying a fork carrier. The fork carrier mast section further comprises a freelift mast system having a pair of fluid actuated rams, one of the fluid actuated rams being operable to positively control the upward movement of the forks relative the mast section and the other of the fluid actuated rams being operable to positively control the downward movement of the forks relative the mast section.

By having such a truck mounted forklift, there will no longer be a need for the driver to secure the forks in position using locking pins. The forks will be prevented from moving upwardly by the fluid actuated ram operable to positively control the downward movement of the forks relative the mast section and therefore negative lift will be easily generated to load the forklift onto a truck or to assist in the mounting of a step. Negative lift may be achieved without having to secure the forks in position using locking pins. The driver of the forklift will not have to spend a significant amount of time aligning the forks with the inner mast section in order to insert the locking pins and will also not have to alight from their vehicle in order to insert the locking pins. This results in a significant time saving to the driver of the vehicle when they are doing their deliveries. Furthermore, by avoiding having to use locking pins there is no longer the possibility of the locking pins becoming mislaid or damaged which is a further frequent cause of delay and expense when carrying out deliveries.

Generally, the inner fork carrying mast section comprises a substantially rectangular frame having a pair of substantially parallel upright side bars bridged at their upper ends by an upper cross member and bridged at their lower ends by a lower cross member, each of the fluid actuated rams is mounted on one of the upper and the lower cross members. Typically, one of the fluid actuated rams is mounted on the upper cross member and the other of the fluid actuated rams is mounted on the lower cross member. Each of the fluid actuated rams is coupled to the forks by way of a pulleyed purchase system, the pulleyed purchase comprises at least one pulley mounted on the fluid actuated ram and a chain connected at one of its ends to the forks and its other end being led over the pulley and secured to the vertical multi-lift mast. Preferably, the pulleyed purchase system is arranged to translate the stroke of the fluid actuated ram into movement of the forks by twice the amount of the stroke of the fluid actuated ram.

In one embodiment of the invention there is provided a feedback circuit between each of the fluid actuated rams so that fluid pumped into the fluid actuated ram to positively control upward movement of the forks relative the mast section is fed from the fluid supply of the fluid actuated ram to positively control downward movement of the forks and fluid pumped into the fluid actuated ram to positively control downward movement of the forks relative the mast section is fed from the fluid supply of the fluid actuated ram to positively control upward movement of the forks.

The fluid actuated rams each comprise a hydraulic ram. Alternatively, the fluid actuated rams could each comprise a pneumatic ram. Normally, the fluid actuated rams are single acting rams. Alternatively, a pair of double acting rams could be used for the fluid actuated rams.

Furthermore, the vertical multi-lift mast comprises three mast sections, an outer mast section, a middle mast section slidably mounted on the outer mast section, and an inner fork-carrying freelift mast section slidably mounted on the middle mast section, each of the mast sections being nestably mounted with respect to each other. In one embodiment of the invention, the vertical multi-lift mast is mounted on a carriage on the u-shaped chassis, the carriage being movable in a fore and aft direction on the chassis. The carriage has rollers for mounting the carriage on each of the side bars, the carriage thus being movable in a fore and aft direction on the chassis under the operation of a carriage moving ram connected between the u-shaped chassis and the carriage. Usually, forks are mounted upon the fork carrier which in turn is slidably mounted on the inner fork carrying mast section. When the forks are mounted on the fork carrier it will be understood that the fluid actuating rams are operable on the carriage and the forks are moved up and down in unison with the carriage. The forks may be pivotally mounted about a longitudinal axis of the forklift truck on the fork carrier and there is provided a tilting ram for tilting the forks relative the carriage. This will allow the forklift to pick up and set down loads that are at an angle to the horizontal in a simple and efficient manner.

The main advantage of the present invention is that the arrangement of providing both positive and negative lift on the free lift mast is particularly advantageous for a piggyback forklift as this will obviate the need for locking pins. The lengthy process of aligning the mast sections for insertion of the locking pins is also avoided, thereby speeding up the loading of the piggyback forklift as well as improving it's maneuverability.

BRIEF DESCRIPTION OF THE INVENTION

The invention will now be more clearly understood from the following description of some embodiments thereof given by way of example only with reference to the accompanying drawings in which:

FIG. 1 it a perspective view of a forklift truck according to the invention;

DETAILED DESCRIPTION OF THE PREFERRED EMBODIMENTS

Figure 1:
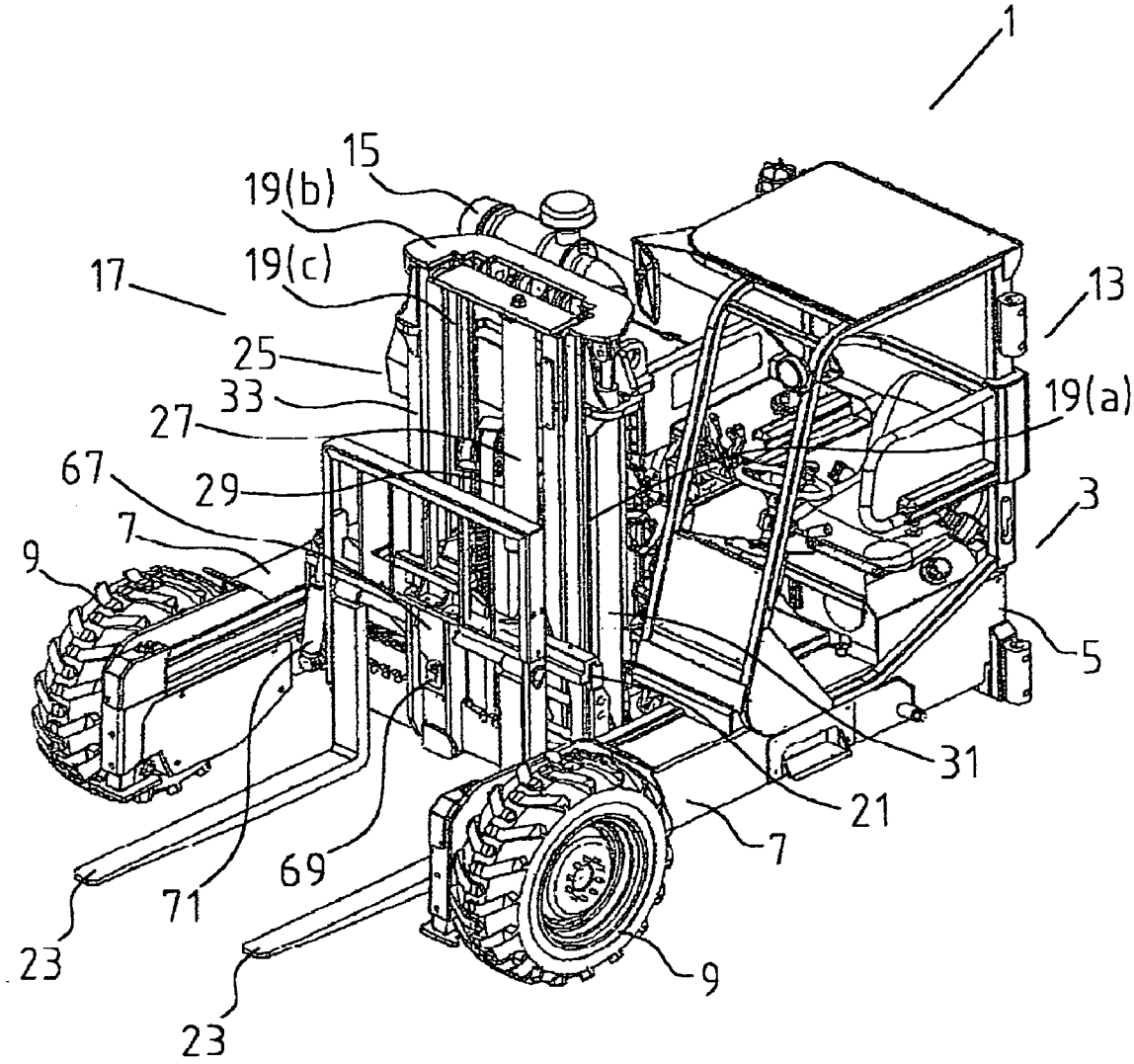
Figure 2:
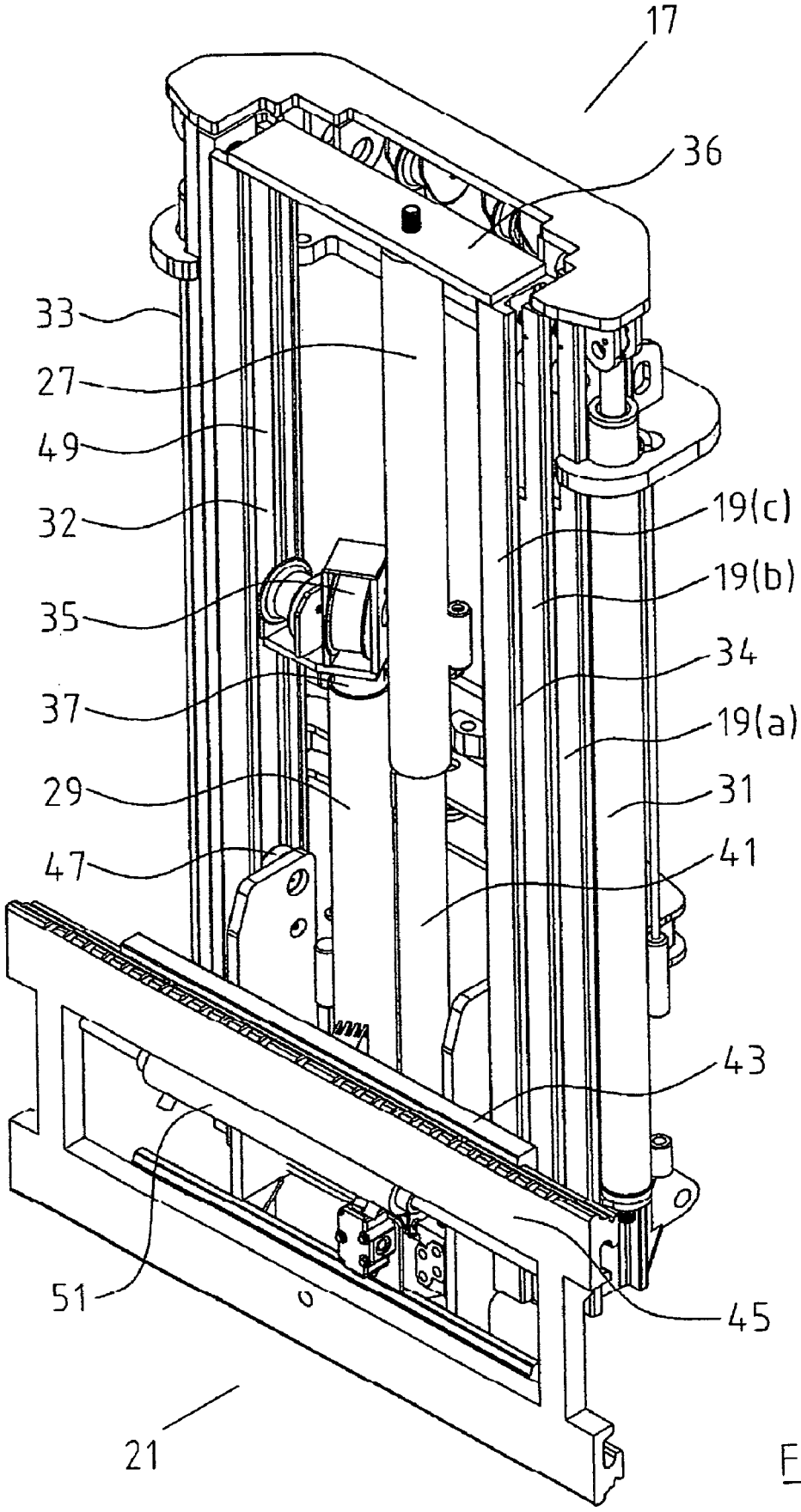
FIG. 2 is a front perspective view of a multi lift mast for use with the forklift truck according to the invention, with all of the chains removed for clarity.
Figure 3:
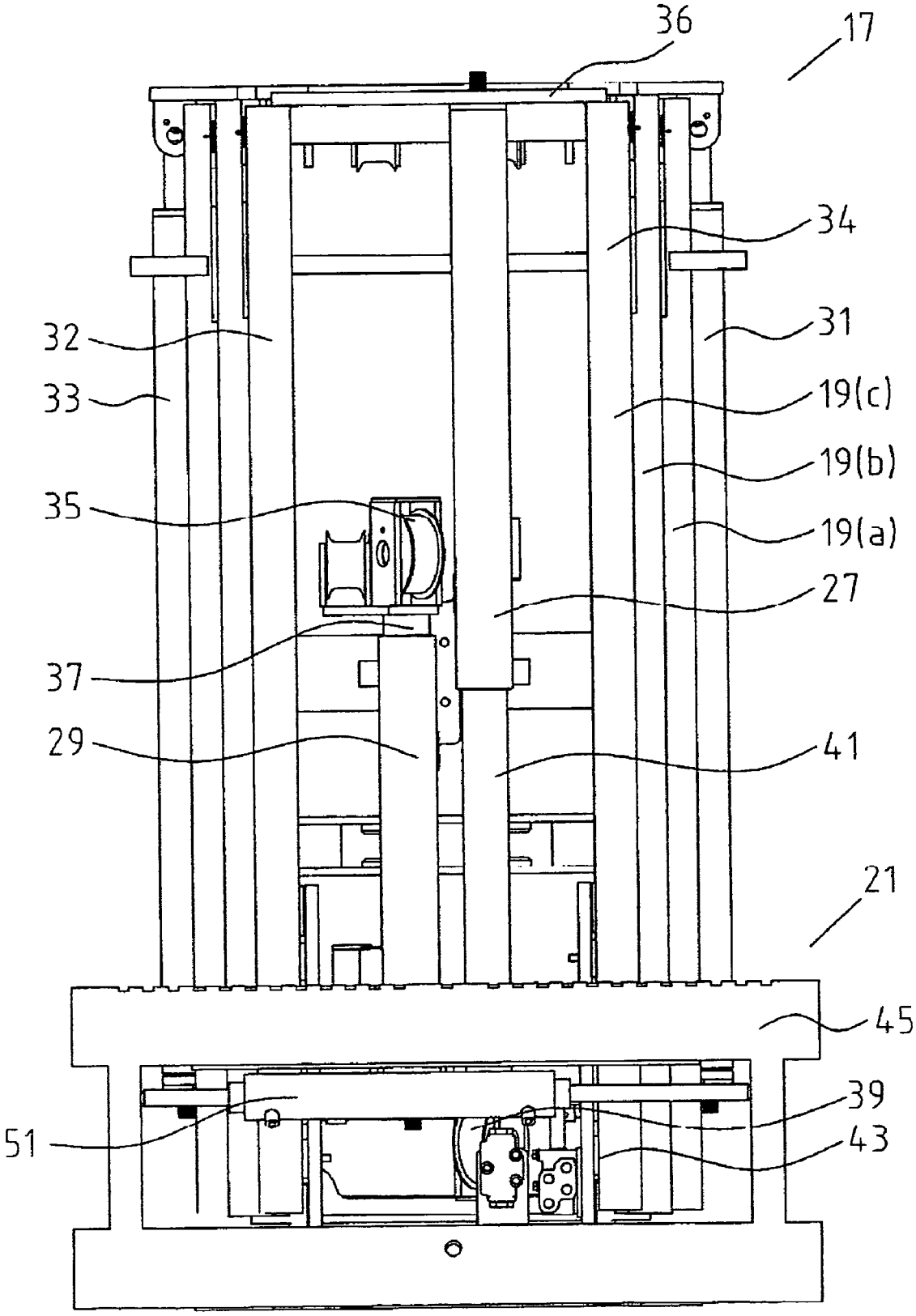
FIG. 3 is a front view of the multi lift mast of FIG. 2.
Figure 4:
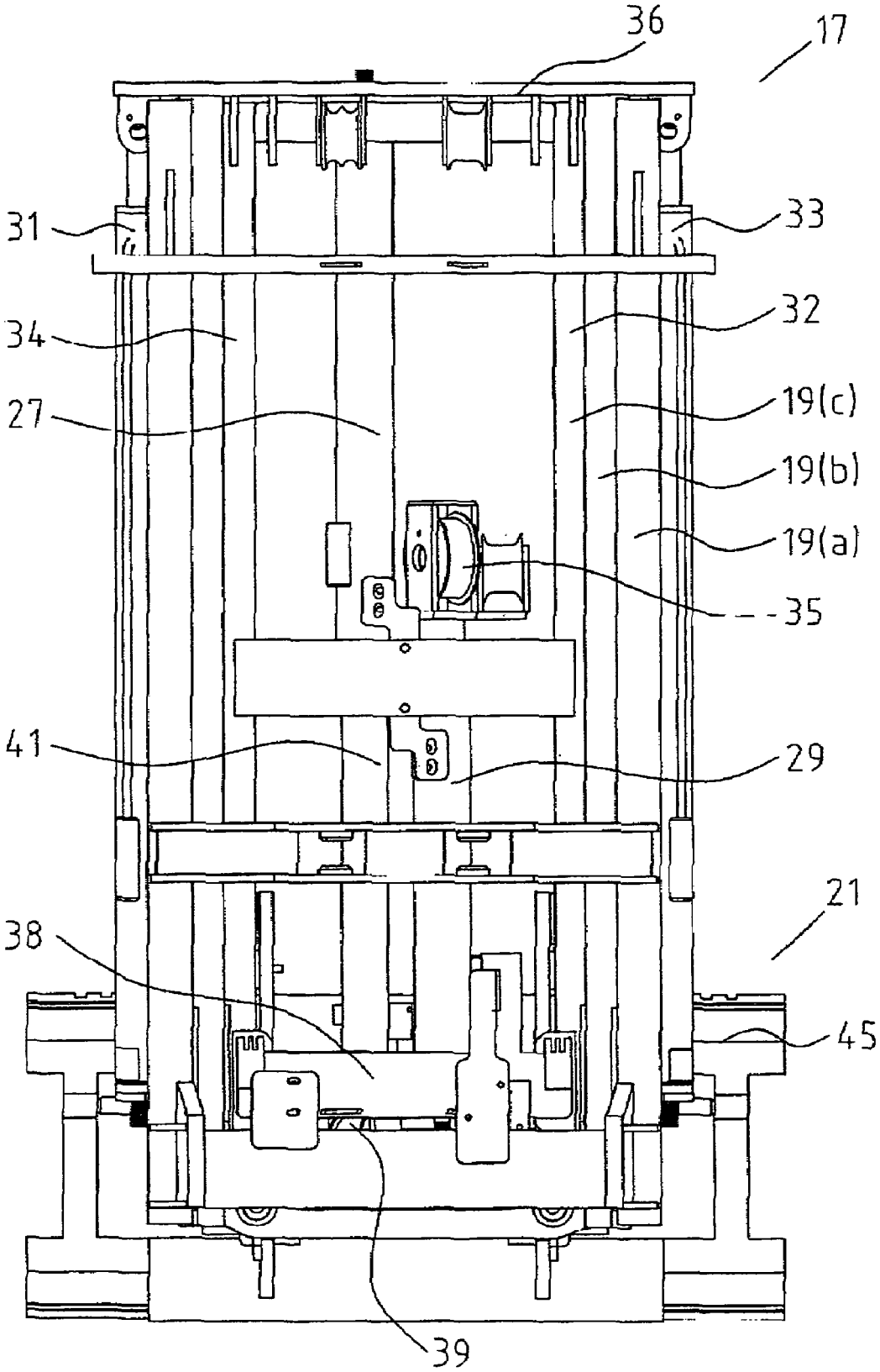
FIG. 4 is a rear view of the multi lift mast of FIG. 2.
Figure 5:
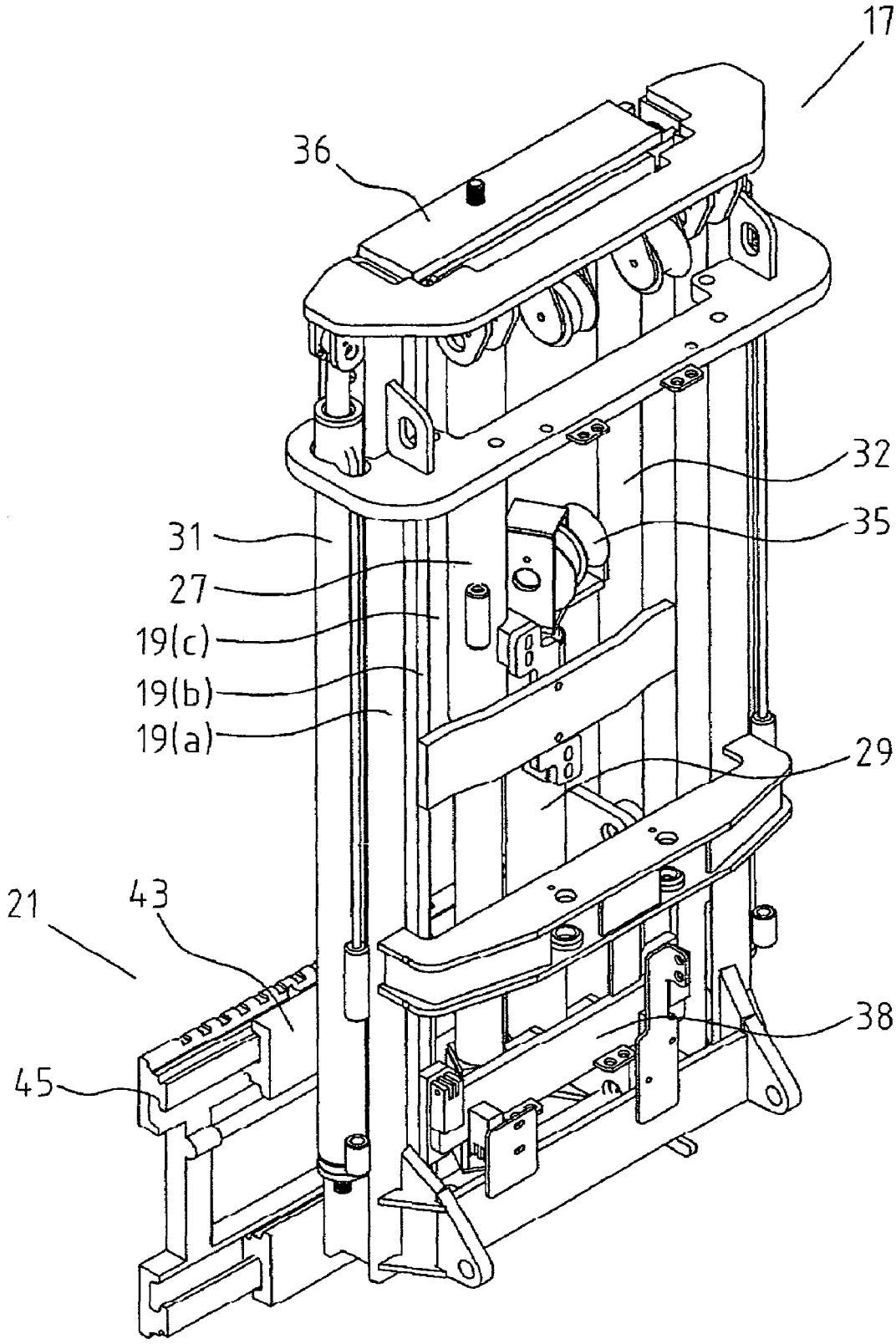
FIG. 5 is a rear perspective view of the multi-lift mast of FIG. 2.
Figure 6:
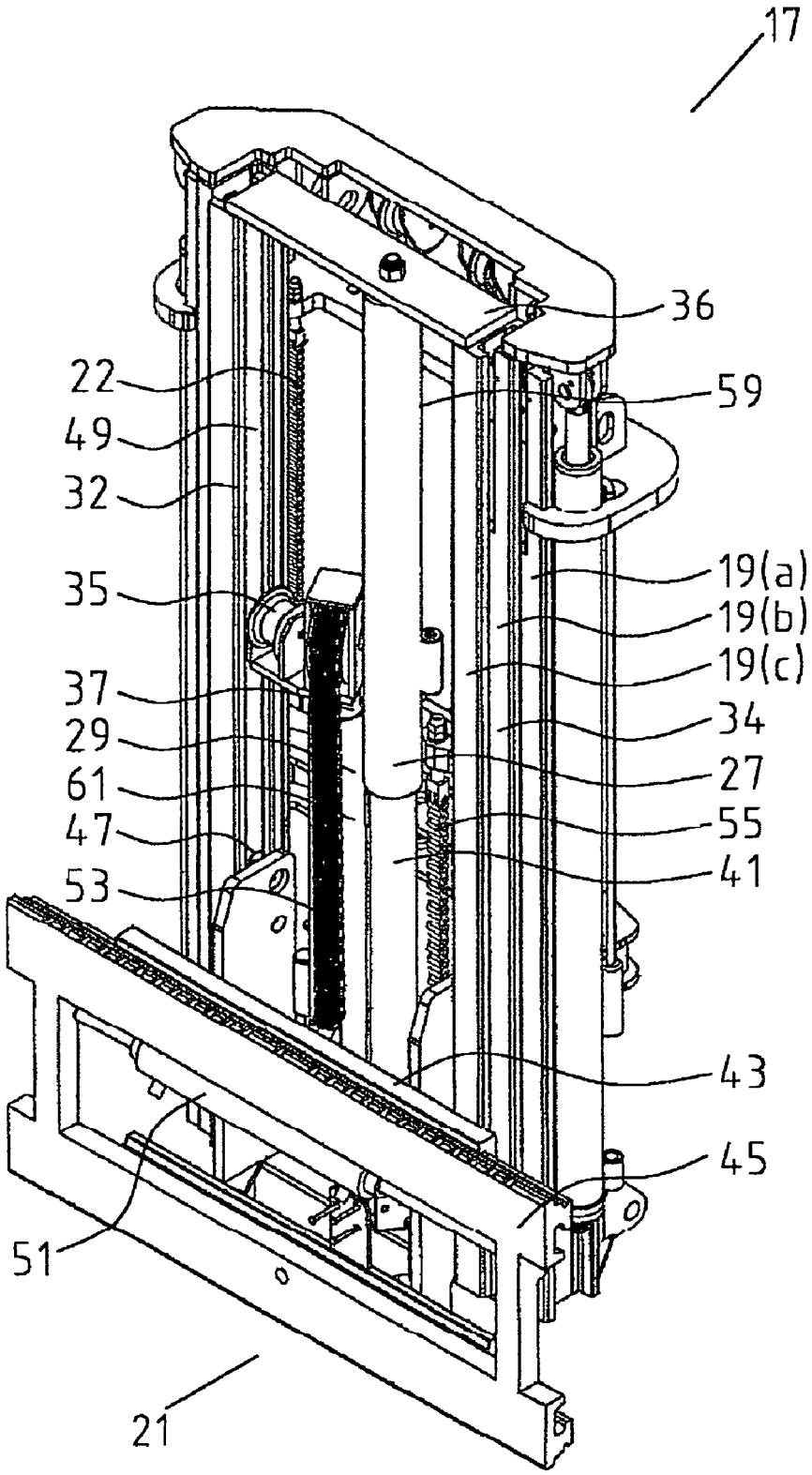
FIG. 6 is a front perspective view of a multi lift mast for use with the forklift truck according to the invention, similar to that shown in FIG. 2 with all of the chains in position.
Figure 7:
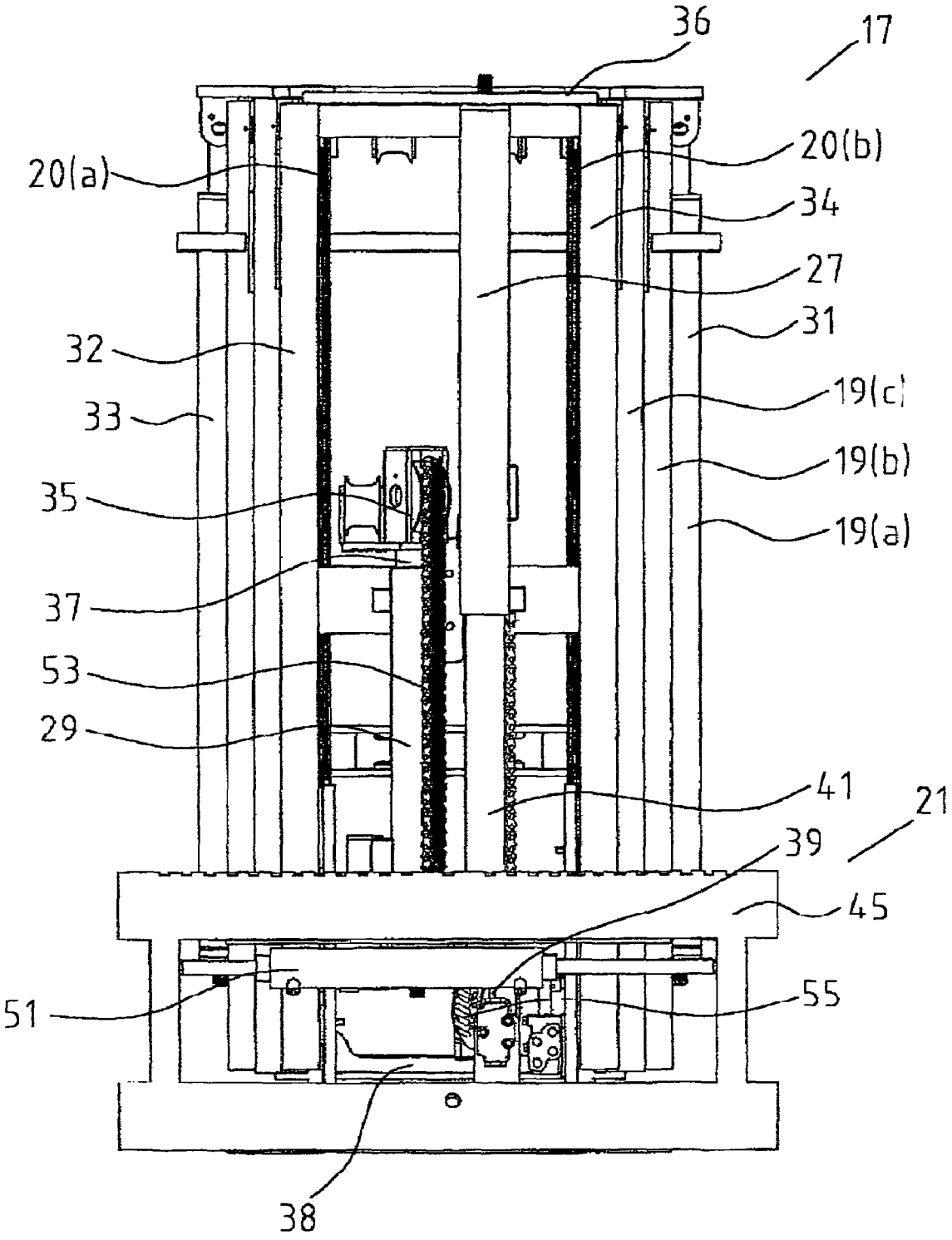
FIG. 7 is a front view of the multi lift mast of FIG. 6.
Figure 8:
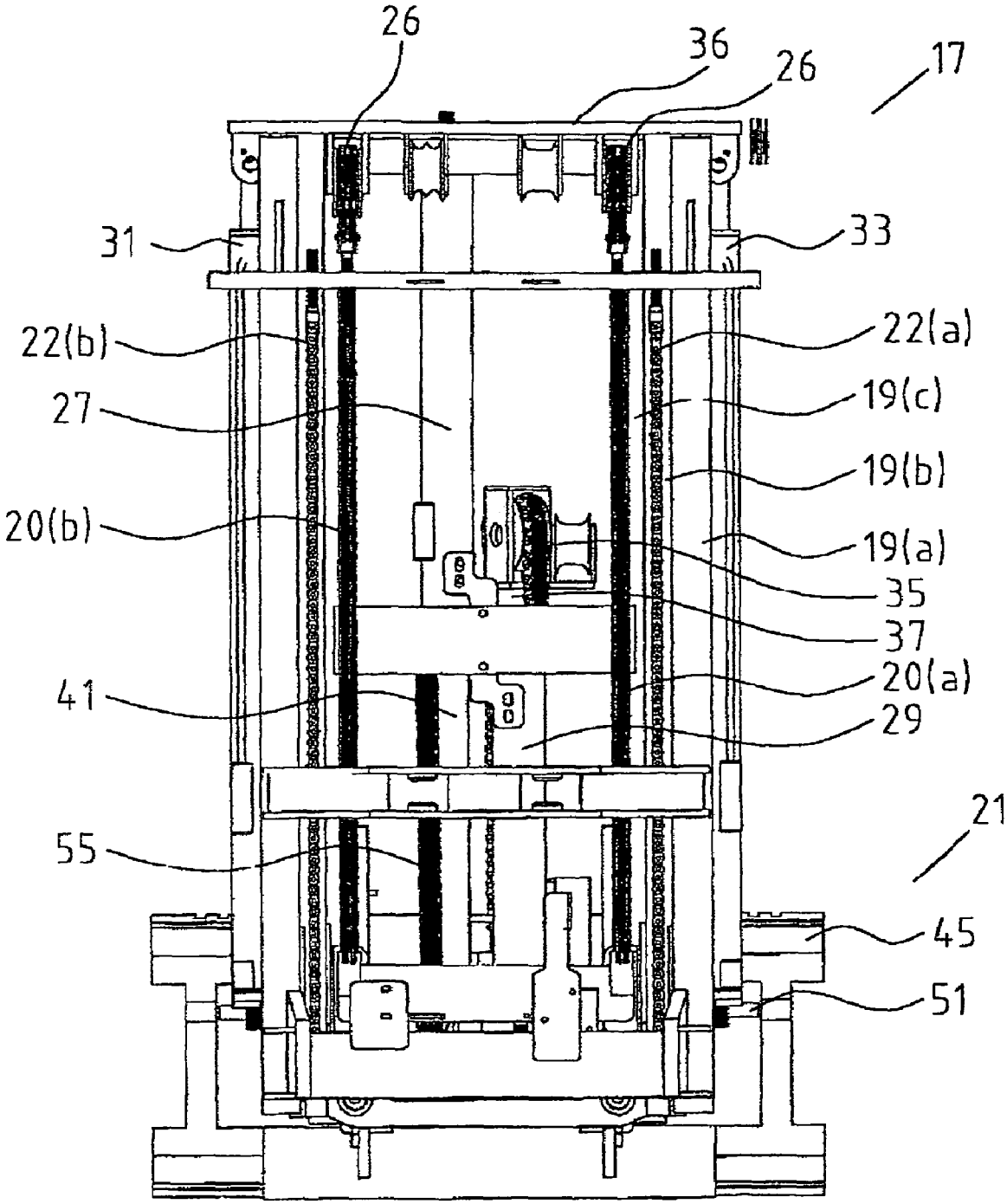
FIG. 8 is a rear view of the multi lift mast of FIG. 6.
Figure 9:
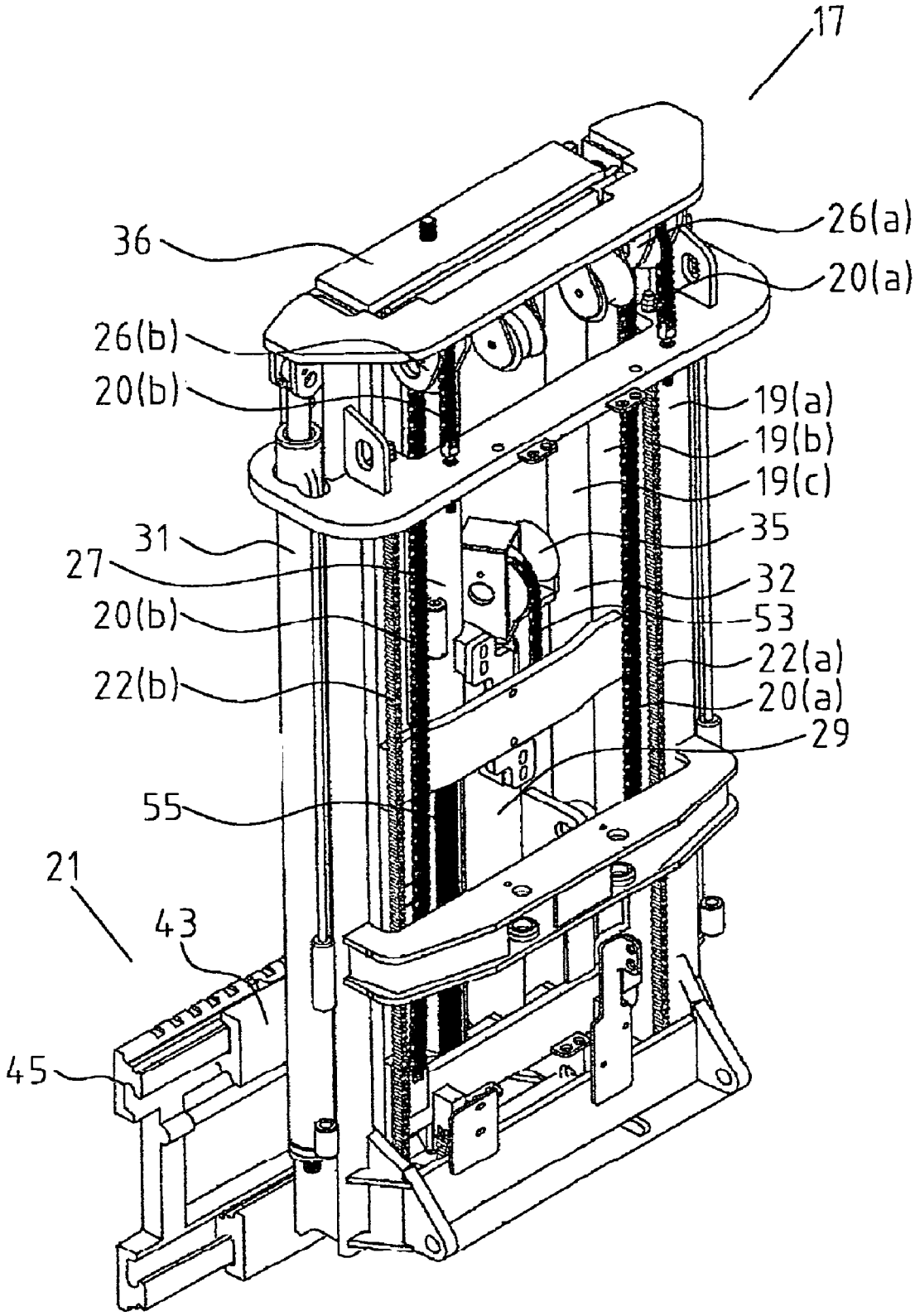
FIG. 9 is a rear perspective view of the multi-lift mast of FIG. 6.

Referring to the drawings and initially to FIG. 1 thereof, there is shown a forklift truck, indicated generally by the reference numeral 1, comprising a u-shaped chassis 3 having a crossbar 5 and a pair of side bars 7 extending forwardly therefrom, each of the side bars has a front wheel 9 mounted towards the free end thereof and a steerable rear wheel (not shown) is located centrally on the crossbar 5. A driver's station 13 is mounted on one side of the chassis 3 and a power motive unit 15 is mounted on the opposite side of the chassis 3 to the driver's station 13. A vertical multi-lift mast 17 is mounted on the chassis 3, the vertical multi-lift mast 17 comprising an outer mast section 19*a*, a middle mast section 19*b* and an inner mast section 19*c*. The middle mast section 19*b* is slidably mounted on the outer mast section 19*a* and the inner mast section 19*c* is in turn slidably mounted on the middle mast section 19*b*. A fork carrier 21 carrying forks 23 is slidably mounted on the inner mast section 19*c* and there is provided a free lift mast system 25 comprising a pair of fluid actuated rams 27, 29, one of which is operable to move the fork carrier 21 and hence the forks 23 upwards relative the inner mast section 19*c* and the other fluid actuated ram being operable to move the fork carrier 21 downwards relative the inner mast section 19*c*. A pair of mast operating fluid actuated rams 31, 33 are also provided, one end of the mast operating fluid actuated rams 31, 33 being connected to the middle mast section 19*b* and the other end of the mast operating fluid actuated rams being connected to the outer mast section 19*a*. An inner mast chain drive (not shown) is provided to cause the inner mast section 19*c* to raise and lower in a controlled manner relative to the middle mast section 19*b* in response to the operation of the mast operating fluid actuated rams 31, 33.

In use, when an operator of the forklift wishes to mount the forklift truck onto the back of a carrying vehicle, the operator drives the forklift to within dose proximity of the rear of the carrying vehicle (not shown). The carrying vehicle is provided with dedicated brackets (not shown) such as those well known In the art for reception of the forks 23 of the piggyback forklift. The operator of the vehicle secures the forks in position by applying fluid to the fluid actuated ram 27 to push the forks downwards until they reach the lowest point relative the inner mast section. At the same time, fluid is removed from the other fluid actuated ram 29 which is arranged to push the forks upwards so that the forks are allowed to travel downwards in a uniform manner. Once the forks 23 are secured in position relative the inner mast section, the operator raises the forks by raising the middle and inner mast sections by operating the fluid actuated rams 31, 33 until the forks are located adjacent the brackets. The operator of the forklift then drives the vehicle forwards until the forks are in engagement in the brackets. Once the forks are fully secured in the brackets, the operator of the forklift then operates the fluid actuated rams 31, 33 once more to lower the inner and middle mast sections relative the outer mast sections. As the forks are secured in the brackets on the carrying vehicle this has the effect of providing negative lift and raises the vehicle upwards relative the carrying vehicle. Once in a raised position suitable for transport chains (not shown) may be provided to secure the forklift in position.

As an alternative way of mounting the forklift onto the back of a carrying vehicle, once the forklift is in position relative the carrying vehicle, the mast could be fully lowered by the mast operating fluid actuated rams 31, 33. The operator of the vehicle then operates the fluid actuated rams 27, 29 of the freelift mast system to raise the forks 23 until they are adjacent the brackets on the carrying vehicle. Once in position, the forklift may be advanced forwards so that the forks engage the brackets on the carrying vehicle. When the forks 23 are secured in the brackets, negative lift is achieved by operating the fluid actuated rams 27, 29 of the freelift mast system in unison to cause the forks to lower relative the inner mast section. As the forks 23 are secured in the brackets on the carrying vehicle, the forklift truck is caused to rise relative the carrying vehicle. Again, once the forklift has been raised into a transporting position, chains and other such securing devices for securing the forklift in position relative the carrying vehicle may be applied.

Referring now to FIGS. 2 to 5 inclusive there is shown a number of views of a multi stage mast for use with a forklift truck according to the present invention. The chains of both the pulley purchase system and the inner mast chain drive have been removed for reasons of clarity. The inner mast section 19*c* further comprises a substantially rectangular frame having a pair of substantially parallel uprights 32, 34 bridged at their upper ends by an upper cross member 36 and bridged at their lower ends by a lower cross member 38. The fluid actuating ram 29 is mounted on the lower cross member and is operable to move the forks upwards relative the inner frame and the fluid actuating ram 27 is mounted on the upper cross member 36 and is operable to move the forks downwards relative the inner frame.

A chain (not shown) is connected to the carriage 21 and is led around pulley 35 on, the piston rod 37 of tho fluid actuating ram 29 before the other end of the chain is secured to the inner mast section 19*c*. Similarly, another chain (not shown) is secured to the carriage 21 and led around a pulley 39 on the piston rod 41 of the fluid actuated ram 27, before the other end of that chain is secured to the inner mast section. The carriage 21 further comprises a fixed carriage portion 43 and a moveable carriage portion 45. The fixed carriage portion 43 is mounted by way of rollers 47 which are retained in tracks 49 on the inner mast section 19*c* and is slidably mounted up and down the tracks 49 on the inner mast section 19*c*. The moveable carriage 45 carries the forks (not shown) and is slidably mounted with respect to the fixed carriage portion 43 in a transverse direction with respect to the main longitudinal axis of the forklift truck A side shift ram 51 is provided to move the moveable carriage 45 in a transverse direction on the fixed carriage 43. In this way the forks may be adjusted sideways in order to engage a load.

Referring now to FIGS. 6 to 9 inclusive there is shown a number of views of the multi lift mast similar to those shown in FIGS. 2 to 5, where like parts have been given the same reference numerals as before in which the chains of the pulley purchase system and the chains of the inner mast drive are shown. A pulley purchase chain 53 is connected to the carriage 21 at one end and its other end is led over the pulley 35 of the piston rod 37 of the fluid actuated ram 29 before its other end is secured to the inner mast section. Similarly, a pulley purchase chain 55 is connected to the carriage 21 at one end and its other end is led over the pulley 39 of the piston rod 41 of the other fluid actuated ram 27 before being secured to the inner mast section. As the piston rod 37 of the fluid actuated ram 29 is pushed outwards the chain 53 causes the carriage 21 to rise by an amount twice that of the distance travelled by the piston rod 37. When the piston rod 37 is being extended in this fashion the other fluid actuated ram 27 is operated in the opposite fashion so that the piston rod 41 is retracted into the fluid actuated ram cylinder 59 of the fluid actuated ram 27. Both of the fluid actuated rams 27, 29 shown are single acting rams. Therefore, in order to retract the piston rod 41 of the fluid actuated ram 27, the fluid pressure is released from the cylinder 59 of that ram and the action of the pulley purchase chain 55 on the piston rod 41 via the pulley 39 as the carriage is moved upwards by the fluid actuated ram 29 will cause the piston rod 41 to retract into the cylinder 59.

Similarly, in order to retract the piston rod 37 of the fluid actuated ram 29, the fluid pressure is gradually released from the ram cylinder 61 of the fluid actuated ram 29 and fluid is delivered to the cylinder 59 of the other fluid actuated ram 27. In this way, as the piston 41 of the fluid actuated ram 27 moves downwards thereby pushing the carriage downwards, the chain 53 will tend to urge the piston 37 back into the ram cylinder 61. The two fluid supplies of the fluid actuated rams 27 and 29 are interconnected by a feedback circuit (not shown) between each of the fluid actuated rams 27, 29, so that fluid pumped into the cylinder 61 of the fluid actuated ram 29 to positively control upward movement of the forks relative the inner mast section is fed from the fluid supply of the fluid actuated ram 27 to positively control downward movement of the forks 23 and fluid pumped into cylinder 59 of the fluid actuated ram 27 to positively control downward movement of the forks relative the mast section is fed from the fluid supply of the fluid actuated ram 29 to positively control upward movement of the forks. As an alternative to the above, the fluid actuated cylinders 27, 29 could both be provided by double acting rams capable of retracting their respective pistons without the need for a force to be exerted through their respective chains 53, 55. The double acting rams would also have to be operated in synchronisation with each other so that as one of the fluid actuated rams 27, 29 is being positively retracted, the other of the fluid actuated rams 27, 29 is being positively extended and vice versa. It will be understood that the fluid supplies of both of the rams could be synchronised to provide a smooth movement of the carriage.

The inner mast chain drive will now be described with reference to FIGS. 6 to 9 inclusive. The inner mast chain drive comprises a first set of chains 20*a*, 20*b* each of which is secured at one end to the outer mast section 19*a* and led over a pulley 26*a*, 26*b*, respectively, towards the upper part of the middle mast section 19*b* and their other end is secured towards the lower end of the inner mast section 19*c* , and a second set of chains 22*a*, 22*b* that are each secured at one end to the outer mast section 19*a* before being led over a pulley (not shown) at the lower end of the middle mast section 19*b* before being secured to the inner mast section 19*c* in this way, as the middle mast section 19*b* is raised relative the outer mast section 19*a* by the fluid actuated rams 31, 33, the first set of chains 20*a*, 20*b* which are fixed at one end to the outer mast section and led over a pulley at the top of the middle mast section will be effectively tensioned thereby causing the inner mast section 19*c* to rise relative the middle mast section 19*b*. As the first set of chains are effectively tensioned the second set of chains are simultaneously effectively slackened by the movement upwards of the middle mast section thereby allowing the mast to rise upwards. Similarly, when the fluid actuating rams 31, 33 are caused to lower the middle mast section relative the outer mast section, the second set of chains 22*a*, 22*b* become effectively tensioned thereby drawing the inner mast section 19*c* downwards while at the same time the first set of chains 20*a*, 20*b* is effectively slackened by the movement of the middle mast section 19*b* downwards thereby allowing the inner mast section 19*c* to move downwards relative the middle mast section 19*b*. Movement of the inner mast section relative the middle mast section without movement of the rams 31, 33 is prevented by the chains 20*a*, 20*b*, 22*a* and 22*b*.

Figure 10:
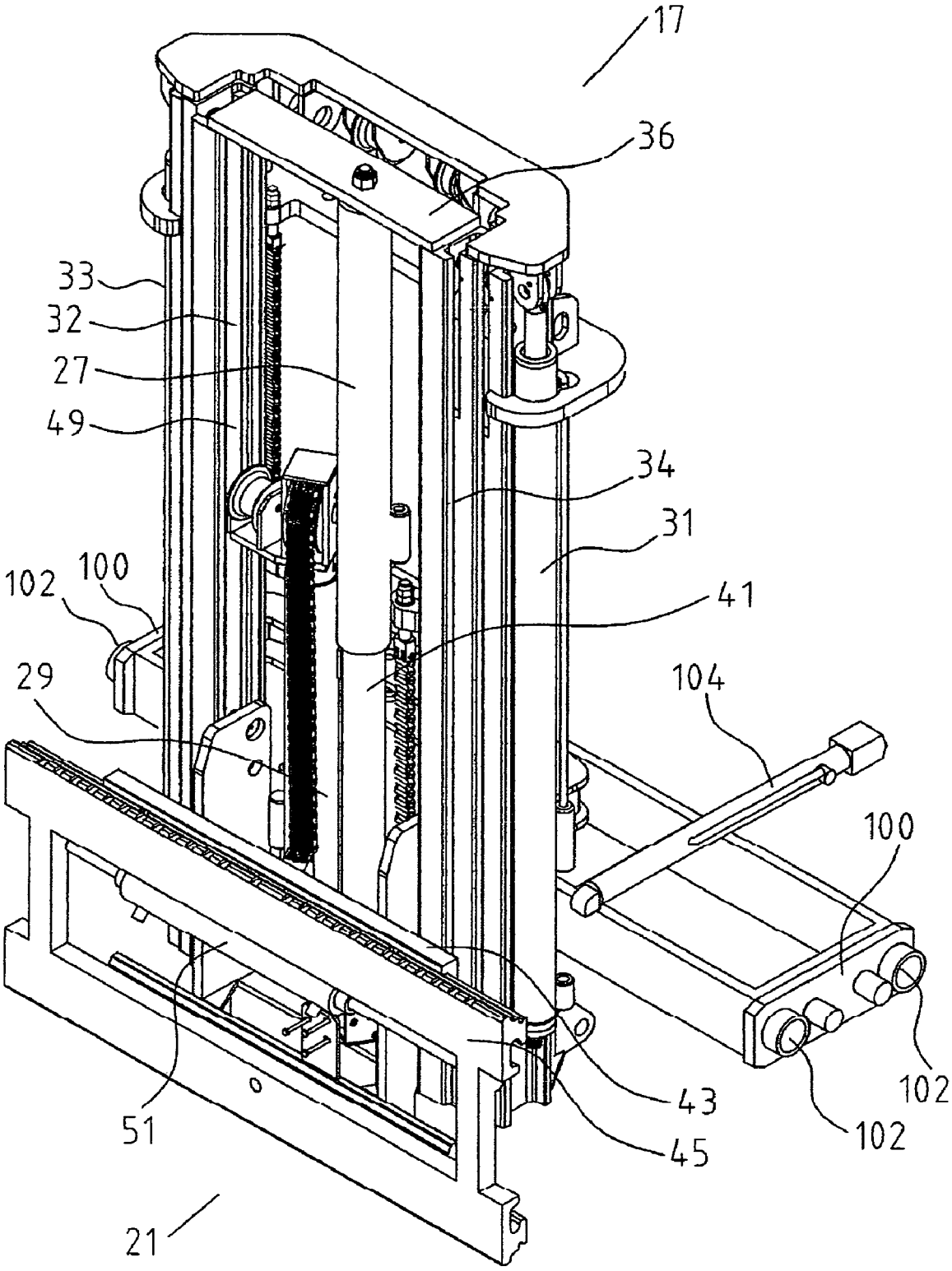
FIG. 10 is a front perspective view of a multi-lift mast of FIG. 2 mounted on a mast carriage.

Referring to FIG. 10 of the drawings there is shown a perspective view of a multistage mast having a freelift mast system, the mast being mounted on a mast carriage 100. The mast carriage 100 has a plurality of rollers 102 for engagement of the tracks on the side bars of the u-shaped chassis. A carriage moving actuating ram 104 is further provided, one end of which is connected to the mast carriage 100, the other end of which is mounted on the u-shaped chassis, to allow movement of the mast carriage 100 and the mast 17 forwards and backwards on the u-shaped chassis.

Figure 11:
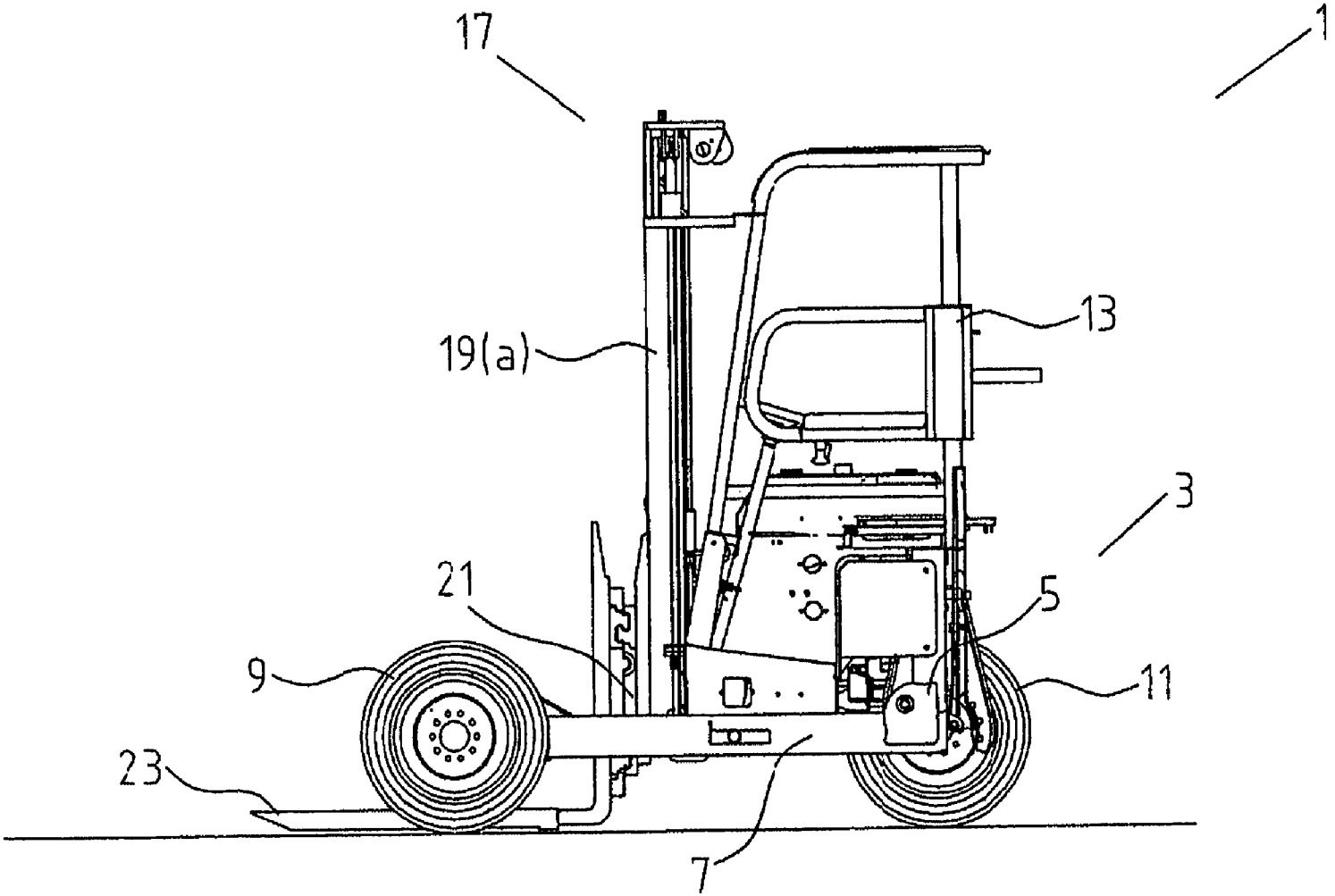
FIG. 11 is a side view of a forklift truck according to the invention with the mast and the forks in a fully lowered position.
Figure 12:
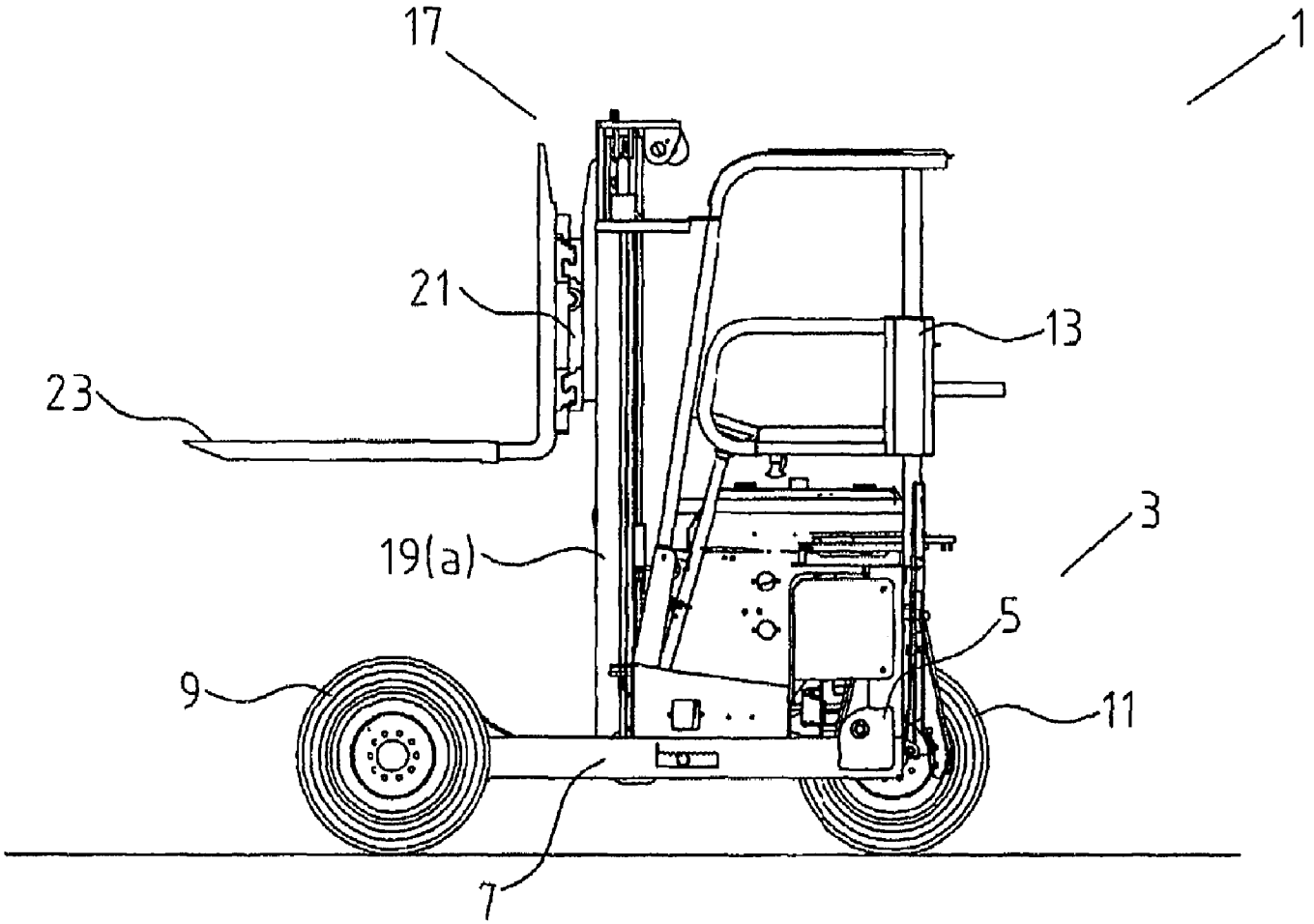
FIG. 12 is a side view of a forklift truck according to the invention with the mast in the lowered position and the forks in a fully raised position relative the inner mast section.
Figure 13:
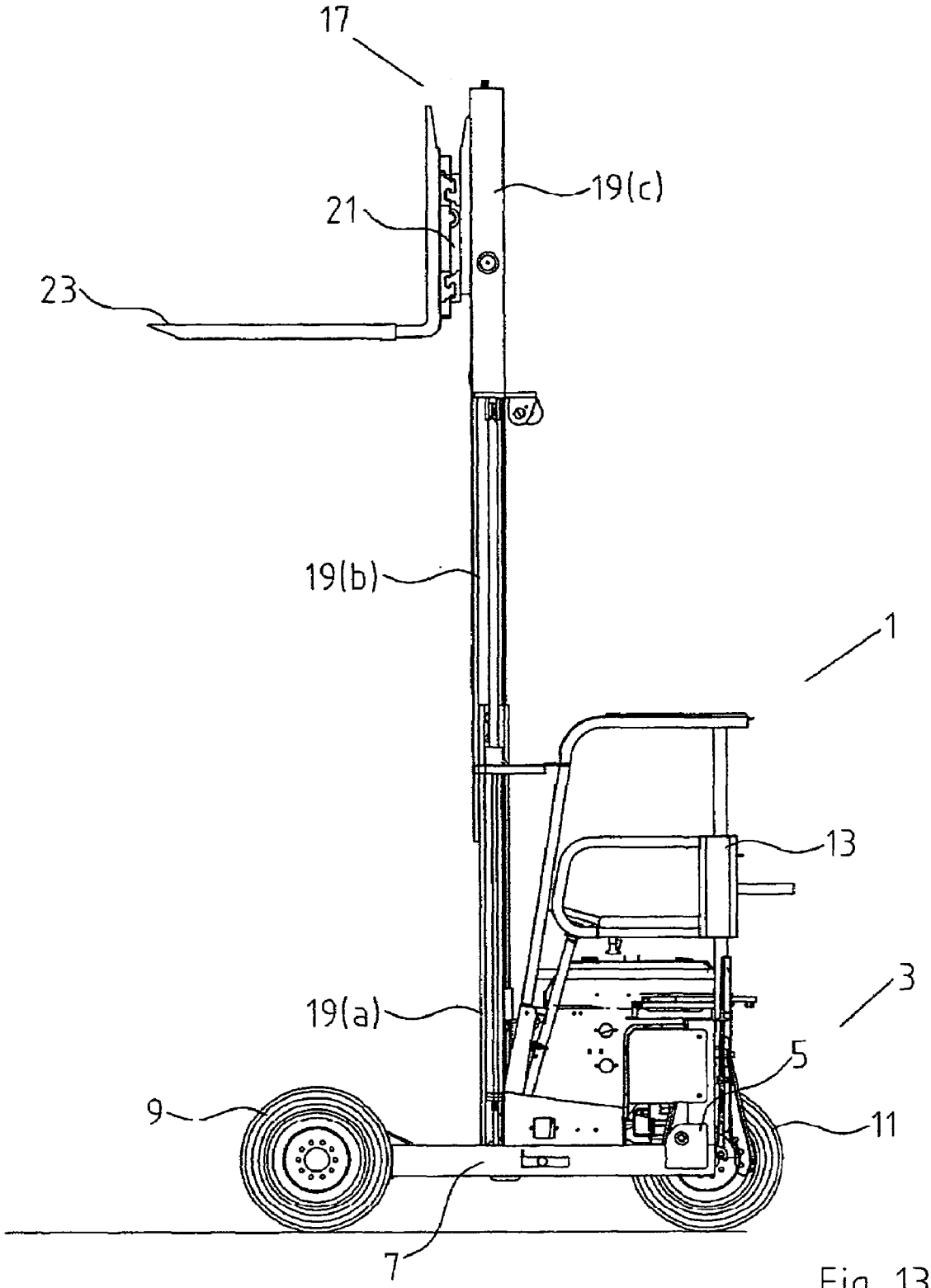
FIG. 13 is a side view of a forklift truck according to the invention with the mast and the forks In a fully raised position.

Finally, referring now to FIGS. 11 to 13 inclusive there are shown a number of side views of a forklift truck for mounting on the rear of a carrying vehicle shown in operation. The forklift trucks steerable rear wheel can be seen clearly from the drawings. In FIG. 11, the forklift truck is shown with the mast 17 and the forks 23 in a fully lowered configuration. In FIG. 12, the free lift mast system has been operated to raise the forks 23 and the carriage 21 relative the inner mast section 19*c* without increasing the overall height of the mast. In FIG. 13, the mast sections 19*a*, 19*b* and 19*c* have all been extended to show the maximum reach of the forklift. The freelift mast system used in accordance with the invention will allow the carriage to be raised and lowered in a controlled manner with respect to the inner mast section thereby obviating the need for pins and allowing for more precise positioning of the forks.

The carriage 21 shown in FIG. 1 is in fact a multiple part carriage comprising a fixed carriage portion 43 and a moveable carriage portion 45. The fixed carriage portion 43 is mounted by way of rollers 47 which are retained in tracks 49 on the inner mast section 19*c* and is slidably mounted up and down the tack on the inner mast section. A side shift ram 51 is provided to move the moveable carriage 45 In a transverse direction on the fixed carriage 43. In this way the forks may be adjusted sideways in order to engage a load. In addition to this, the forks 23 are in fact mounted on a fork bracket 67 which is in turn pivotally mounted about the moveable carriage 45 about pivot point 69 so that the forks on the fork bracket are able to rotate in a plane transverse to the longitudinal axis of the forklift truck under the action of a tilting jack 71. This will enable the forklift to engage loads that are at a different orientation to the forks.

In the specification the terms "comprise, comprises, comprised and comprising" or any variation thereof and the terms "include, includes, included and including" or any variation thereof are considered to be totally interchangeable and they should all be afforded the widest possible Interpretation and vice versa.

The invention is in no way limited to the embodiments hereinbefore described, but may be varied in both construction and detail within the scope of the claims.

The invention claimed is:

1. A forklift truck for mounting on the rear of a carrying vehicle comprising:

a U-shaped chassis having a crossbar and a pair of side bars mounted at the ends of the crossbar and projecting forwardly therefrom;

a pair of ground engaging wheels, one wheel being located adjacent the free end of one of the side bars and the other wheel being located adjacent the free end of the other side bar;

a steerable ground engaging rear wheel located centrally on the crossbar;

a drivers station mounted to one side of the chassis;

a motive power unit mounted on the opposite side of the chassis to the drivers station;

a vertical multi-lift mast mounted on the chassis between the side bars, the vertical multi-lift mast having a plurality of mast sections;

a fork carrier slidably mounted on one of the mast sections;

a freelift mast system mounted on one of the mast sections coupled to the fork carrier, the free lift mast system comprising a pair of fluid actuated rams, one of the fluid actuated rams being operable to positively control the upward movement of the fork carrier relative the mast section and the other of the fluid actuated rams being operable to positively control the downward movement of the fork carrier relative the mast section;

the fork carrier bearing mast section comprises a substantially rectangular frame having a pair of substantially parallel upright side bars bridged at their upper ends by an upper cross member and bridged at their lower ends by a lower cross member, each of the fluid actuated rams being mounted on one of the upper and the lower cross members and in which one of the fluid actuated rams being mounted on the upper cross member and the other of the fluid actuated rams being mounted on the lower cross member.

2. A forklift truck for mounting on the rear of a carrying vehicle as claimed in claim 1 in which each of the fluid actuated rams is coupled to the fork carrier by way of a pulleyed purchase system, the pulleyed purchase system comprising at least one pulley mounted on the fluid actuated ram and a chain connected at one of its ends to the fork carrier and its other end being led over the pulley and secured to the vertical multi-lift mast.

3. A forklift truck as claimed in claim 2 in which the pulleyed purchase system is arranged to translate the stroke of the fluid actuated cylinder into movement of the fork carrier by twice the amount of the stroke of the fluid actuated cylinder.

4. A forklift truck for mounting on the rear of a carrying vehicle as claimed in claim 1 in which there is provided a feedback circuit between each of the fluid actuated rams so that fluid pumped into the fluid actuated ram to positively control upward movement of the fork carrier relative to the lift section is fed from the fluid supply of the fluid actuated ram to positively control downward movement of the fork carrier and fluid pumped into the fluid actuated ram to positively control downward movement of the fork carrier relative the lift section is fed from the fluid supply of the fluid actuated ram to positively control upward movement of the fork carrier.

5. A forklift truck for mounting on the rear of a carrying vehicle as claimed in claim 1 in which the vertical multi-lift mast comprises three lift sections, an outer lift section, a middle lift section slidably mounted on the outer lift section, and an inner fork-carrying freelift section slidably mounted on the middle lift section, each of the lift sections being nestably mounted with respect to each other.

6. A forklift truck for mounting on the rear of a carrying vehicle as claimed in claim 1 in which the fluid actuated rams each comprise a hydraulic ram.

7. A forklift truck for mounting on the rear of a carrying vehicle as claimed in claim 1 in which the fluid actuated rams each comprise a pneumatic ram.

8. A forklift truck for mounting on the rear of a carrying vehicle as claimed in claim 1 in which the vertical multi-lift mast is mounted on a mast carriage on the u-shaped chassis, the mast carriage having rollers for mounting the carriage on each of the side bars, the frame being movable in a fore and aft direction on the chassis under the operation of a carriage moving actuating ram connected between the u-shaped chassis and the carriage.

9. A forklift truck for mounting on the rear of a carrying vehicle as claimed in claim 1 in which there are provided a pair of forks mounted on the fork carrier, the forks being pivotally mounted about a longitudinal axis of the forklift truck on the fork carrier and there is provided a tilting ram connected between the forks and the fork carrier for tilting the forks relative the carriage.

10. A forklift truck for mounting on the rear of a carrying vehicle as claimed in claim 1 in which the fluid actuated rams are single acting rams.

11. A forklift truck for mounting on the rear of a carrying vehicle as claimed in claim 1 in which the fluid actuated rams are double acting rams.

12. A forklift truck for mounting on the rear of a carrying vehicle comprising:

a U-shaped chassis having a crossbar and a pair of side bars mounted at the ends of the crossbar and projecting forwardly therefrom;

a pair of ground engaging wheels, one wheel being located adjacent the free end of one of the side bars and the other wheel being located adjacent the free end of the other side bar;

a steerable ground engaging rear wheel located centrally on the crossbar;

a drivers station mounted to one side of the chassis;

a motive power unit mounted on the opposite side of the chassis to the drivers station;

a vertical multi-lift mast mounted on the chassis between the side bars, the vertical multi-lift mast having a plurality of mast sections;

a fork carrier slidably mounted on one of the mast sections, the fork carrier bearing mast section comprises a substantially rectangular frame having a pair of substantially parallel upright side bars bridged at their upper ends by an upper cross member and bridged at their lower ends by a lower cross member;

a freelift mast system mounted on the fork carrier bearing mast section coupled to the fork carrier, the free lift mast system comprising a pair of fluid actuated rams, each of the fluid actuated rams is mounted on one of the upper and the lower cross members, one of the fluid actuated rams being operable to positively control the upward movement of the fork carrier relative the mast section and the other of the fluid actuated rams being operable to positively control the downward movement of the fork carrier relative the mast section; and one of the fluid activated rams being mounted on the upper cross member and the other of the fluid actuated rams being mounted on the lower cross member.

13. A forklift truck for mounting on the rear of a carrying vehicle as claimed in claim 12 in which each of the fluid actuated rams is coupled to the fork carrier by way of a pulleyed purchase system, the pulleyed purchase system comprising at least one pulley mounted on the fluid actuated ram and a chain connected at one of its ends to the fork carrier and its other end being led over the pulley and secured to the vertical multi-lift mast.

14. A forklift truck for mounting on the rear of a carrying vehicle as claimed in claim 12 in which there is provided a feedback circuit between each of the fluid actuated rams so that fluid pumped into the fluid actuated ram to positively control upward movement of the fork carrier relative the lift section is fed from the fluid supply of the fluid actuated ram to positively control downward movement of the fork carrier and fluid pumped into the fluid actuated ram to positively control downward movement of the fork carrier relative the lift section is fed from the fluid supply of the fluid actuated ram to positively control upward movement of the fork carrier.

15. A forklift truck for mounting on the rear of a carrying vehicle as claimed in claim 12 in which the vertical multi-lift mast is mounted on a carriage on the u-shaped chassis, the carriage having rollers for mounting the carriage on each of the side bars, the carriage being movable in a fore and aft direction on the chassis under the operation of a carriage moving ram connected between the u-shaped chassis and the carriage.

16. A forklift truck for mounting on the rear of a carrying vehicle as claimed in claim 12 in which there are provided a pair of forks mounted on the fork carrier, the forks being pivotally mounted about a longitudinal axis of the forklift truck on the fork carrier and there is provided a tilting ram connected between the forks and the fork carrier for tilting the forks relative the carriage.

17. A forklift truck for mounting on the rear of a carrying vehicle as claimed in claim 12 in which the fluid actuated rams are single acting rams.

18. A forklift truck for mounting on the rear of a carrying vehicle as claimed in claim 12 in which the fluid actuated rams are double acting rams.

* * * * *